US009127555B2

(12) United States Patent
Muscat et al.

(10) Patent No.: US 9,127,555 B2
(45) Date of Patent: Sep. 8, 2015

(54) METHOD FOR BALANCING ROTATING ASSEMBLY OF GAS TURBINE ENGINE

(75) Inventors: Cory P. Muscat, Poway, CA (US); James A. Barber, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 989 days.

(21) Appl. No.: 12/974,091

(22) Filed: Dec. 21, 2010

(65) Prior Publication Data

US 2012/0151937 A1 Jun. 21, 2012

(51) Int. Cl.

*F01D 9/00* (2006.01)
*F01D 5/02* (2006.01)
*F01D 9/04* (2006.01)

(52) U.S. Cl.

CPC ..... *F01D 5/027* (2013.01); *F01D 9/042* (2013.01); *F05D 2230/80* (2013.01); *F05D 2260/15* (2013.01); *F05D 2260/34* (2013.01); *Y10T 29/49233* (2015.01)

(58) Field of Classification Search

CPC ..... F01D 5/027; F01D 9/042
USPC ..... 415/201, 209.3, 155, 160, 161; 416/144, 204 R, 206, 207, 208, 500; 700/279

See application file for complete search history.

(56) References Cited

U.S. PATENT DOCUMENTS

| | | | | | |
|---|---|---|---|---|---|
| 3,362,160 | A | * | 1/1968 | Bourgeois | 60/805 |
| 3,985,465 | A | * | 10/1976 | Sheldon et al. | 415/189 |
| 4,169,692 | A | * | 10/1979 | McDonough et al. | 415/115 |
| 4,245,954 | A | * | 1/1981 | Glenn | 415/200 |
| 5,226,789 | A | | 7/1993 | Donges | |
| 5,407,322 | A | * | 4/1995 | Charbonnel et al. | 415/160 |
| 5,487,640 | A | * | 1/1996 | Shaffer | 415/119 |
| 5,545,010 | A | | 8/1996 | Cederwall et al. | |
| 5,584,658 | A | * | 12/1996 | Stenneler | 416/215 |
| 5,807,072 | A | * | 9/1998 | Payling | 415/170.1 |
| 2006/0266114 | A1 | | 11/2006 | Pichel et al. | |
| 2009/0320496 | A1 | | 12/2009 | Faulder et al. | |

* cited by examiner

*Primary Examiner* — Dwayne J White
*Assistant Examiner* — Justin Seabe
(74) *Attorney, Agent, or Firm* — Finnegan, Henderson, Farabow, Garrett & Dunner, LLP

(57) ABSTRACT

A method for balancing a rotating assembly of a gas turbine engine includes removing a stator vane from a section of the gas turbine engine. Removing the stator vane provides access to a rotating assembly of the gas turbine engine. The method further includes at least one of adding, removing, and repositioning a weight with respect to the rotating assembly via access to the rotating assembly provided by removing the stator vane.

18 Claims, 7 Drawing Sheets

METHOD FOR BALANCING ROTATING ASSEMBLY OF GAS TURBINE ENGINE

TECHNICAL FIELD

The present disclosure relates generally to a method for balancing a rotating assembly of a gas turbine engine (GTE) and, more particularly, to a method for balancing the rotating assembly of a GTE including removing a stator vane from the GTE.

BACKGROUND

GTEs convert the potential energy associated with air and fuel into energy primarily in the form of mechanical rotation and heat. A conventional GTE may include a compressor assembly, a combustor assembly, and a turbine assembly. During operation, air is drawn into the compressor assembly, where it is compressed and supplied to the combustor assembly. The combustor assembly supplies fuel to the compressed air and ignites the compressed air and fuel, resulting in combustion, which increases the energy associated with the compressed air. The combustion products are supplied to the turbine assembly, where expansion of the combustion products through the turbine assembly causes a turbine rotor to rotate. A compressor rotor of the compressor assembly and the turbine rotor may be coupled to one another via a shaft, such that rotation of the turbine rotor causes rotation of the compressor rotor. The turbine rotor may also be coupled to one or more systems that use the rotational energy and/or thermal energy from the turbine assembly. For example, a GTE may be used to supply power to machines, such as airplanes, locomotives, boats, ships, trucks, automobiles, electric generators, pumps, or other machines configured to perform work.

During operation, an assembly including the compressor and turbine rotors may rotate at 10,000 or more revolutions per minute, and thus, it may be desirable to balance the rotating assembly in order to prevent excessive vibration during operation of the GTE. One solution for facilitating balancing of the rotating assembly includes coupling a band to the rotating assembly. The band may include a system for attaching one or more weights to the band at different radial locations about the band in order to improve the balance of the rotating assembly. However, by virtue of being coupled to the rotating assembly of the GTE, it may be difficult to gain access to the band because the rotating assembly may be located inside an outer case of the GTE.

A method and apparatus for trim balancing a GTE is disclosed in U.S. Pat. No. 5,545,010 issued to Cederwall et al. ("the '010 patent"). In particular, the '010 patent discloses a method and apparatus that allows a GTE to be balanced with the outer case in situ. Access to a rotor of the GTE from the exterior of the outer case is obtained via the intake opening of the compressor air flow path and a pair of holes that may be sealed using a pair of removable plugs. The '010 patent discloses removing the plugs to obtain access to a band coupled to the rotor, such that balancing can be performed by adding or removing weights or plugs to the band.

Although the method and apparatus disclosed in the '010 patent may permit balancing of the rotor, they may suffer from a number of possible drawbacks. For example, the removable plugs may only be accessed via the intake opening of the compressor air flow path. For some GTEs, it may be desirable to provide a band at a location remote from the intake opening. In addition, providing the band at a location of the rotor remote from the rotor vanes and stator vanes of the compressor assembly may add to the length of the GTE. This may be undesirable for a number of reasons. For example, it may be desirable to reduce the footprint of the GTE, thereby rendering it potentially undesirable to add to the length of the compressor section by virtue of providing space for the band.

The methods and systems described in an exemplary manner in the present disclosure may be directed to mitigating or overcoming one or more of the potential drawbacks set forth above.

SUMMARY

In one aspect, the present disclosure includes a method for balancing a rotating assembly of a gas turbine engine. The method includes removing a stator vane from a section of the gas turbine engine, wherein removing the stator vane provides access to a rotating assembly of the gas turbine engine. The method further includes at least one of adding, removing, and repositioning a weight with respect to the rotating assembly via access to the rotating assembly provided by removing the stator vane.

According to another aspect, the disclosure includes a stator vane for a gas turbine engine. The stator vane includes an airfoil configured to direct air and a locator boss coupled to the airfoil and configured to orient the airfoil relative to air flow through the gas turbine engine. The stator vane further includes a stem coupled to the locator boss and extending opposite the airfoil, wherein the stem is configured to facilitate removal of the stator vane from the gas turbine engine.

According to a further aspect, the disclosure includes a gas turbine engine. The gas turbine engine includes an outer case and a compressor section at least partially contained in the outer case. The compressor section includes a plurality of compressor stator vanes and a compressor rotor having a plurality of compressor rotor vanes. The gas turbine engine further includes a combustor section at least partially contained in the outer case. The combustor section is configured to combust compressed air received from the compressor section. The gas turbine engine also includes a turbine section at least partially contained in the outer case. The turbine section includes a plurality of turbine stator vanes and a turbine rotor having a plurality of turbine rotor vanes. At least one of the stator vanes is configured to be removed from the gas turbine engine via a port in the outer case.

DETAILED DESCRIPTION

Figure 1:
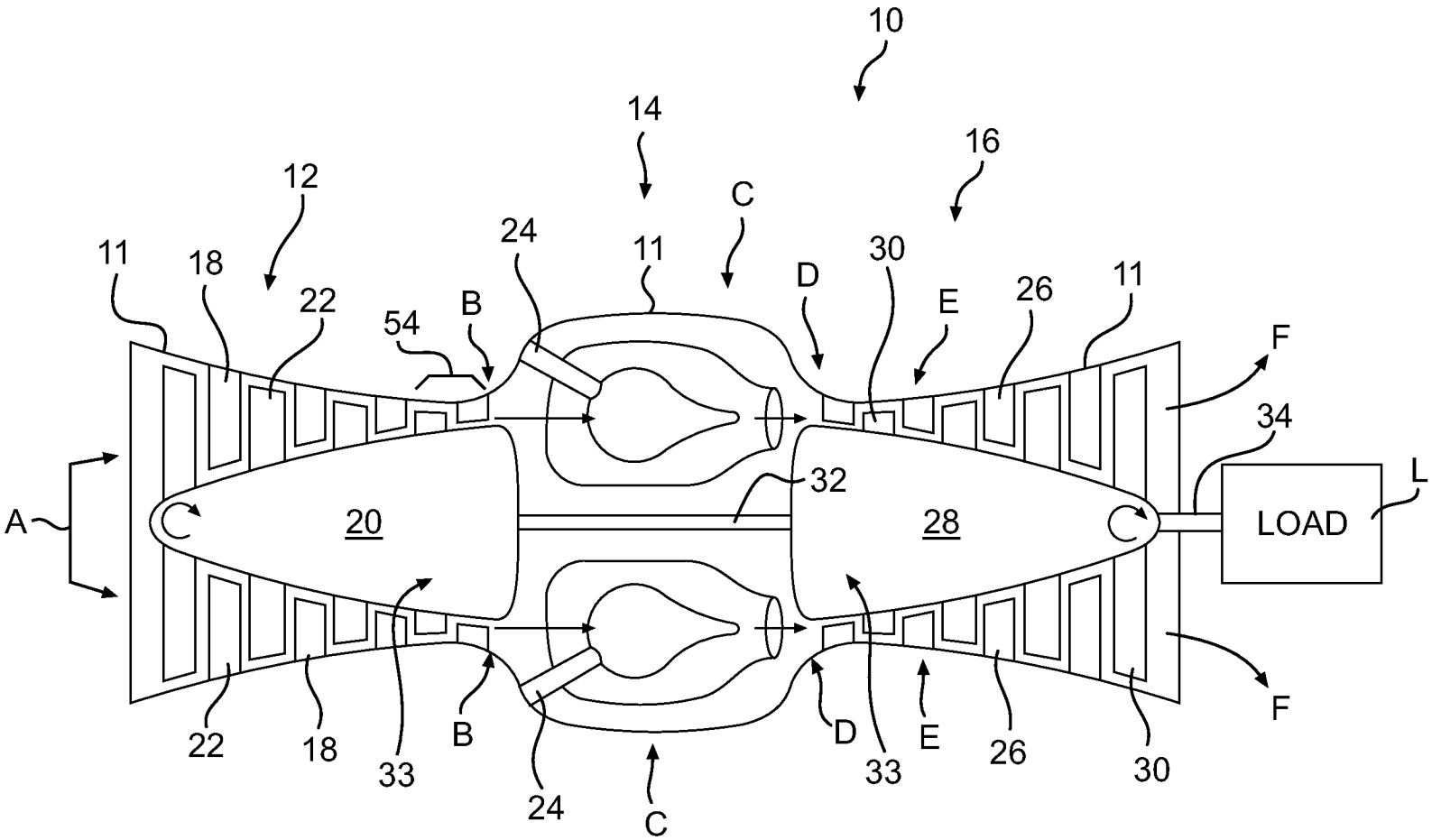
FIG. 1 is a schematic section view of an exemplary embodiment of a GTE.

FIG. 1 schematically illustrates an exemplary embodiment of a GTE 10. Exemplary GTE 10 may include an outer case 11 and a compressor section 12, a combustor section 14, and a turbine section 16 at least partially contained in outer case 11. Compressor section 12 is configured to draw air into GTE at A and compress the air before it enters combustor section 14 at B. Compressor section 12 includes stator vanes 18 and a compressor rotor 20 including rotor vanes 20. Stator vanes 18 and rotor vanes 22 include airfoils, such that as compressor rotor 20 and rotor vanes 22 rotate, air is drawn through compressor section 12, so that it is compressed and acquires a higher pressure by the time the air enters combustor section 14 at B, thereby increasing the potential energy of the air.

The compressed air from compressor section 12 enters combustor section 14 at B, and fuel may be supplied to combustor section 14 via one or more fuel injector(s) 24. The fuel and air are ignited at C, thereby causing the air to expand and enter turbine section 16 upon exit from combustor section 14 at D. Turbine section 16 includes stator vanes 26 and a turbine rotor 28 including rotor vanes 30. Stator vanes 26 and rotor vanes 30 include airfoils and are configured to cause turbine rotor 28 to rotate as the expanding air passes through turbine section 16 at E and exits GTE 10 at F.

GTE 10 may include a shaft 32 coupling compressor rotor 20 and turbine rotor 28 to one another, thereby forming a rotating assembly 33, which may include one or more of compressor rotor 20, turbine rotor 28, and shaft 32. As turbine rotor 28 is driven by expansion of air through stator vanes 26 and rotor vanes 30, shaft 32 transfers the rotating power to compressor rotor 20. As compressor rotor 20 is driven to rotate rotor vanes 22 of compressor section 12, air is drawn into compressor section 12 at A and compressed as it passes through compressor section 12 and exits at B.

According to some embodiments, turbine rotor 28 may be operably coupled to a load L for performing work in addition to being operably coupled to compressor rotor 20. For example, turbine rotor 28 may be coupled to a drive shaft 34 and/or a reduction transmission (not shown), which, in turn, may be coupled to load L, which may be used, for example, to supply power to machines, such as, for example, airplanes, locomotives, boats, ships, trucks, automobiles, electric generators, pumps, and/or other machines configured to perform work.

Figure 2:
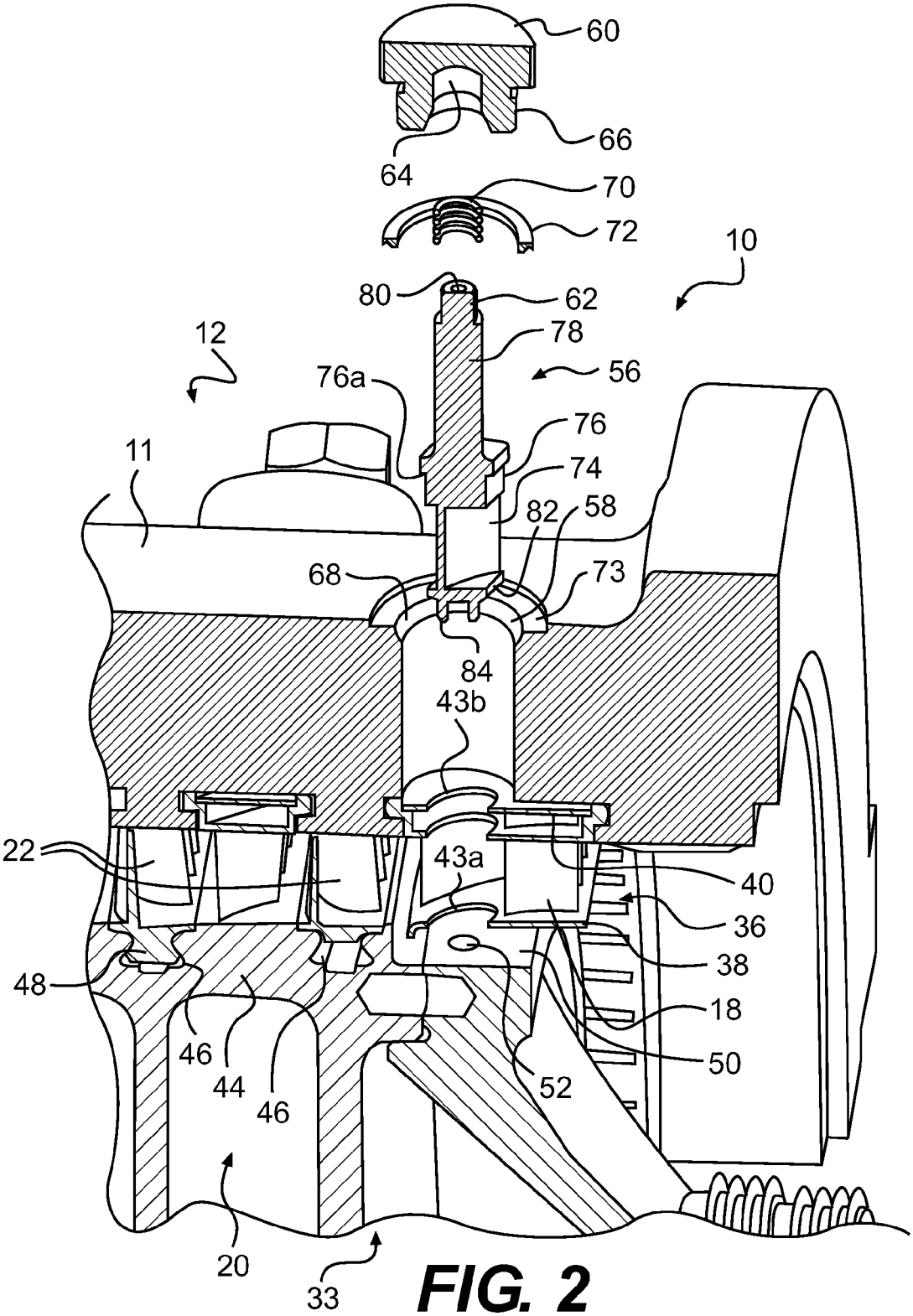
FIG. 2 is a schematic partial perspective section view of a portion of an exemplary embodiment of a GTE.
Figure 4:
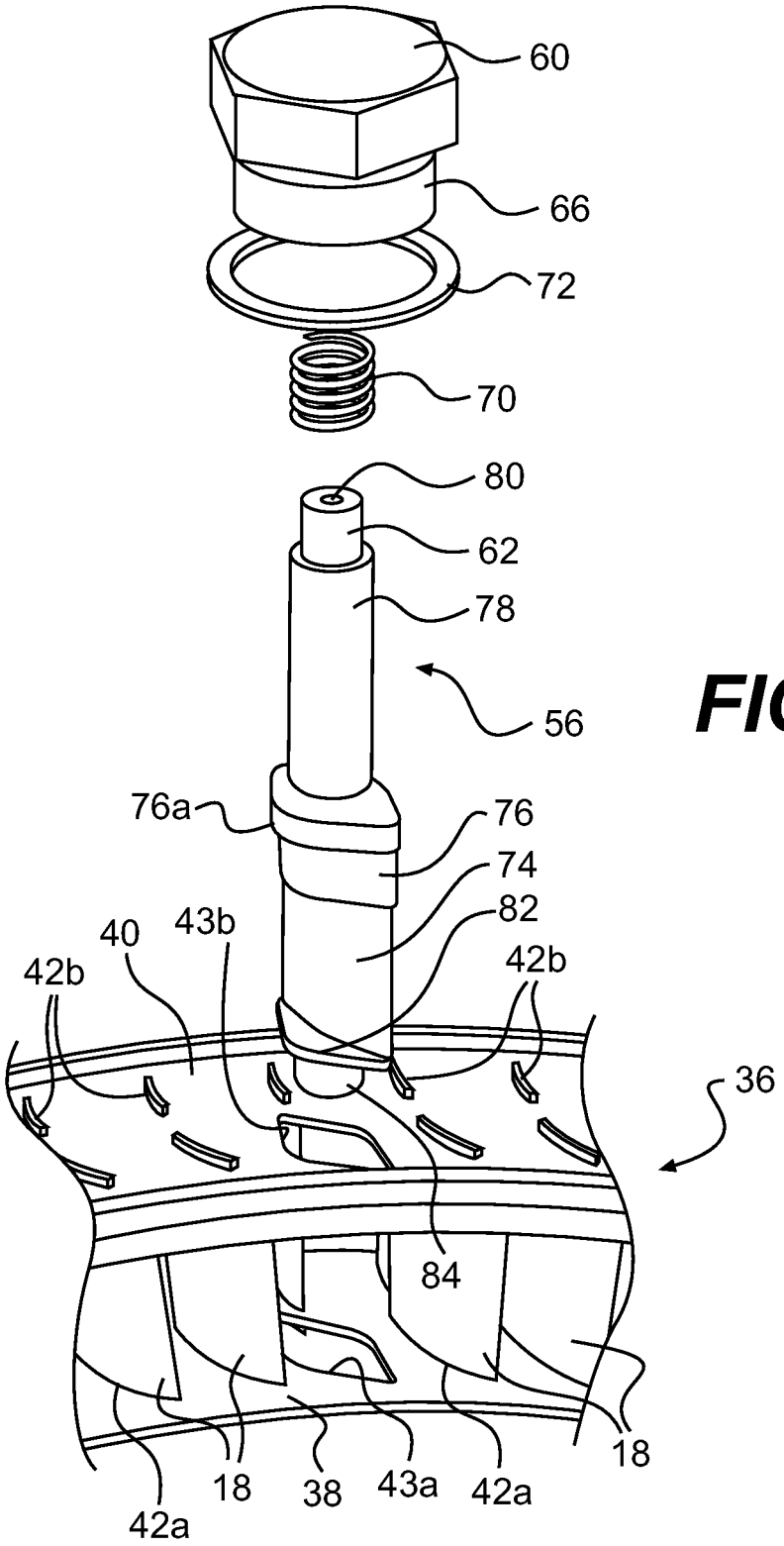
FIG. 4 is a schematic partial perspective exploded view of a portion of an exemplary embodiment of a GTE.

As shown in FIG. 2, exemplary compressor section 12 includes a compressor stator ring assembly 36 coupled to outer case 11. Exemplary stator ring assembly 36 may include a radially inner ring 38 and a radially outer ring 40, between which a plurality of stator vanes 18 extend radially. For example, as shown in FIG. 4, exemplary stator vanes 18 extend between pairs of apertures 42*a* and 42*b* in inner and outer rings 38 and 40, respectively.

As shown in FIG. 2, exemplary compressor rotor 20 includes a hub 44 having a plurality of grooves 46, each configured to receive a plurality of rotary vanes 22. For example, exemplary rotary vanes 22 include a root portion 48 configured to couple rotary vanes 22 to hub 44 via one of grooves 46 via coupling methods known to those skilled in the art.

A balancing ring 50 may be associated with rotating assembly 33 at, for example, compressor rotor 20. Exemplary balancing ring 50 may be either a separate part that is coupled to rotating assembly 33 or formed integrally with a portion of rotating assembly 33. Balancing ring 50 may be configured to facilitate balancing of rotating assembly 33. Exemplary balancing ring 50 may be configured to retain removable weights (not shown) at a number of radial locations around balancing ring 50. For example, as shown in FIG. 2, balancing ring 50 may include a plurality of apertures 52 located radially about balancing ring 50. Apertures 52 may be configured to receive one or more balance weights. According to some embodiments, apertures 52 may be internally threaded to engage with threads of a threaded weight, such as, for example, a bolt, screw, or set screw. As explained in more detail below, by adding, removing, and/or repositioning weights relative to balancing ring 50, the rotating balance of rotating assembly 33 may be improved, which, in turn, may reduce vibration associated with operation of exemplary GTE 10.

Adjacent rows of stator vanes 18 and rotor vanes 22 form stages of exemplary compressor section 12. According to some embodiments, for example, as shown in FIG. 1, balancing ring 50 may be associated with stage 54 that is closest to combustor section 14. This relatively central location along the length of rotating assembly 33 may result in more effective balancing and/or ease of balancing of rotating assembly 33. According to some embodiments, balancing ring 50 may be associated with other positions along the length of rotating assembly 33, such as, for example, on shaft 32 or on turbine rotor 28. Some embodiments of GTE 10 may include more than one balancing ring located at different positions along the length of rotating assembly 33.

Figure 3:
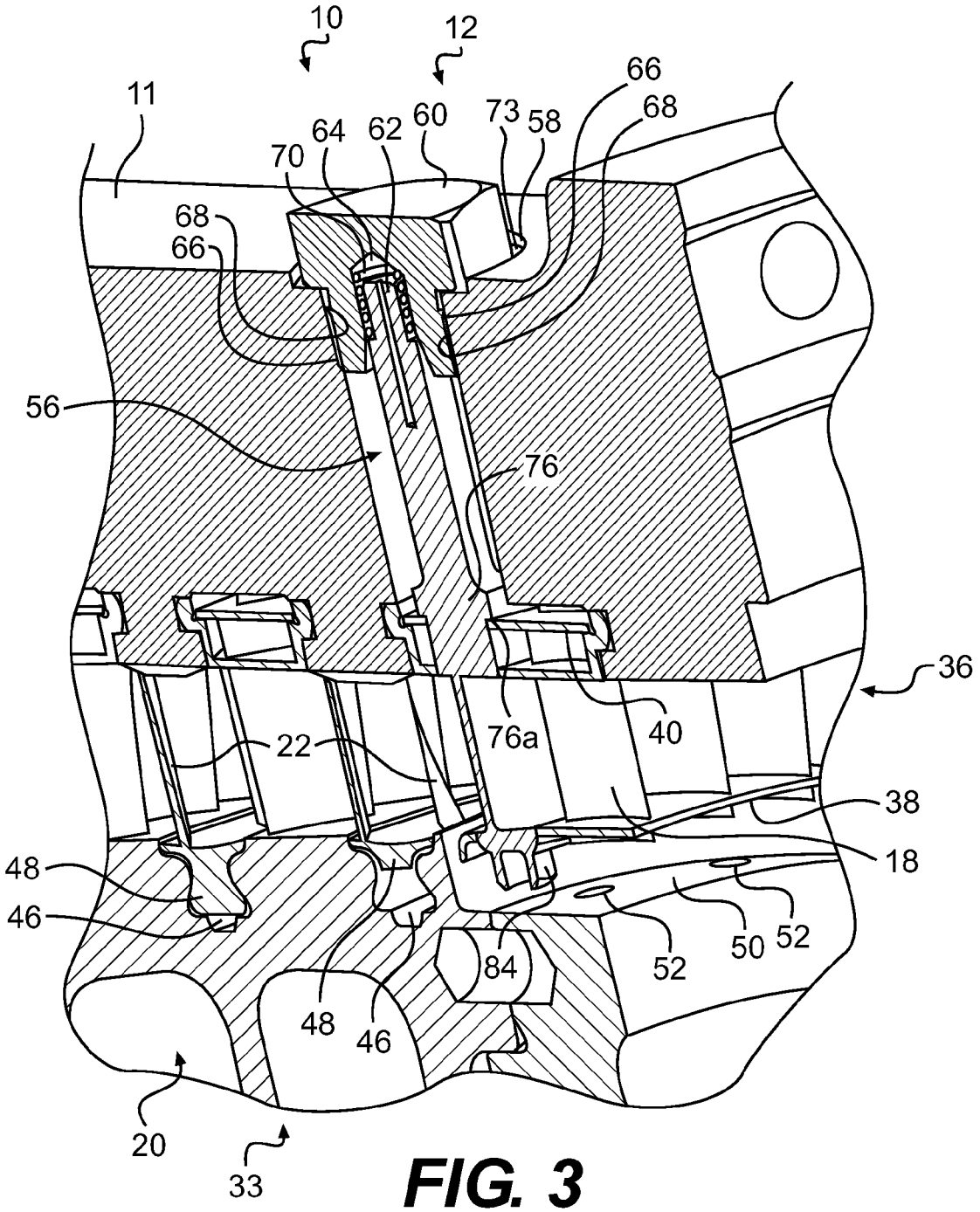
FIG. 3 is a schematic partial perspective section view of a portion of an exemplary embodiment of a GTE.

Referring to FIGS. 2-4, exemplary GTE 10 may include a stator vane 56 configured to be removed from outer casing 11. For example, outer casing 11 of exemplary GTE 10 may include one or more ports 58 through which exemplary stator vane 56 may be removed. Exemplary stator vane 56 may serve as one of a plurality of stator vanes 18 associated with stator ring assembly 36, with stator vane 56 extending through one or more of inner and outer rings 38 and 40, for example, at a position along the length of GTE 10 associated with balancing ring 50. In this exemplary configuration, removal of stator vane 56 may facilitate access to balancing ring 50, so that the rotating balance of rotating assembly 33 may be improved, for example, by adding removing, and/or repositioning weight relative to balancing ring 50.

As shown in FIG. 4, exemplary stator vane 56 may be received in relatively enlarged apertures 43*a* and 43*b* of inner and outer rings 38 and 40, respectively, of stator ring assembly 36. As shown in FIGS. 2 and 3, a cap 60 may serve to retain an end of exemplary stator vane 56 and/or close port 58. According to some embodiments, cap 60 and/or the end of stator vane 56 associated with cap 60 may be configured to provide longitudinal movement of stator vane 56 relative to outer case 11, which may result from temperature changes and/or gradients during operation of GTE 10. For example, the end of stator vane 56 associated with cap 60 may include an extension 62 configured to be received in a recess 64 in cap 60. In the exemplary embodiment shown, cap 60 includes an externally-threaded portion 66 configured to engage internal threads 68 associated with port 58 of outer case 11.

According to some embodiments, a biasing member 70 such as, for example, a coil spring, may be associated with cap 60 and extension 62 of stator vane 56 in order to bias stator vane 56 in position with respect to stator ring assembly 36. For example, biasing member 70 may be configured to slide over extension 62, so that biasing member 70 is positioned between extension 62 of stator vane 56 and recess 64 in cap 60, for example, as shown in FIG. 3. According to some embodiments, a ring 72, which may serve as a washer and/or seal, may be positioned between cap 60 and outer case 11, for example, in an annular recess 73 in outer case 11, as shown in FIGS. 3 and 4.

Figure 5:
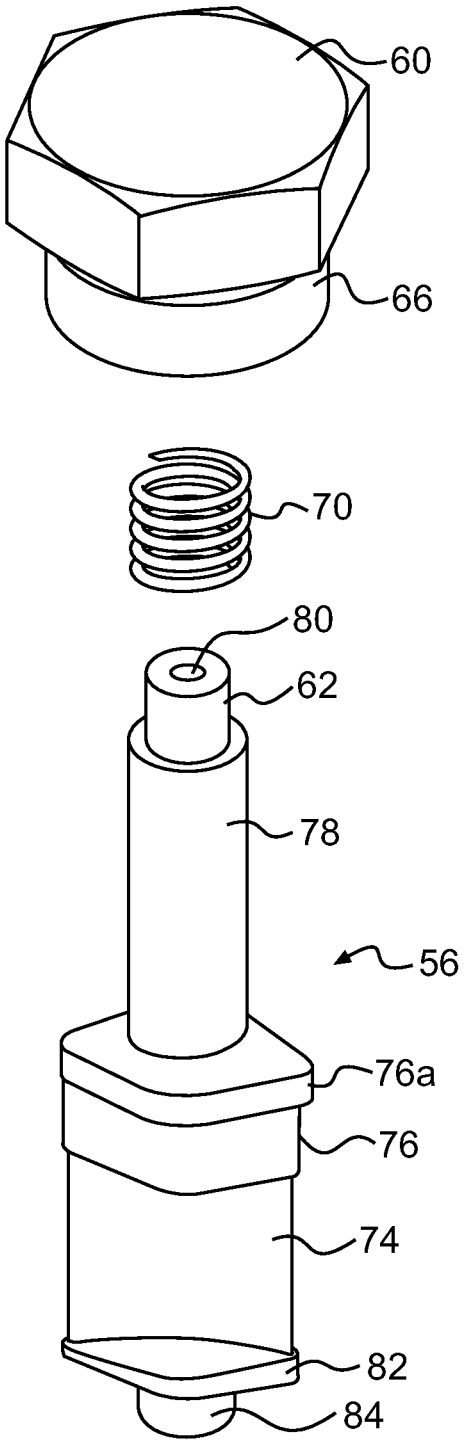
FIG. 5 is a schematic perspective exploded view including an exemplary embodiment of a stator vane.
Figure 6:
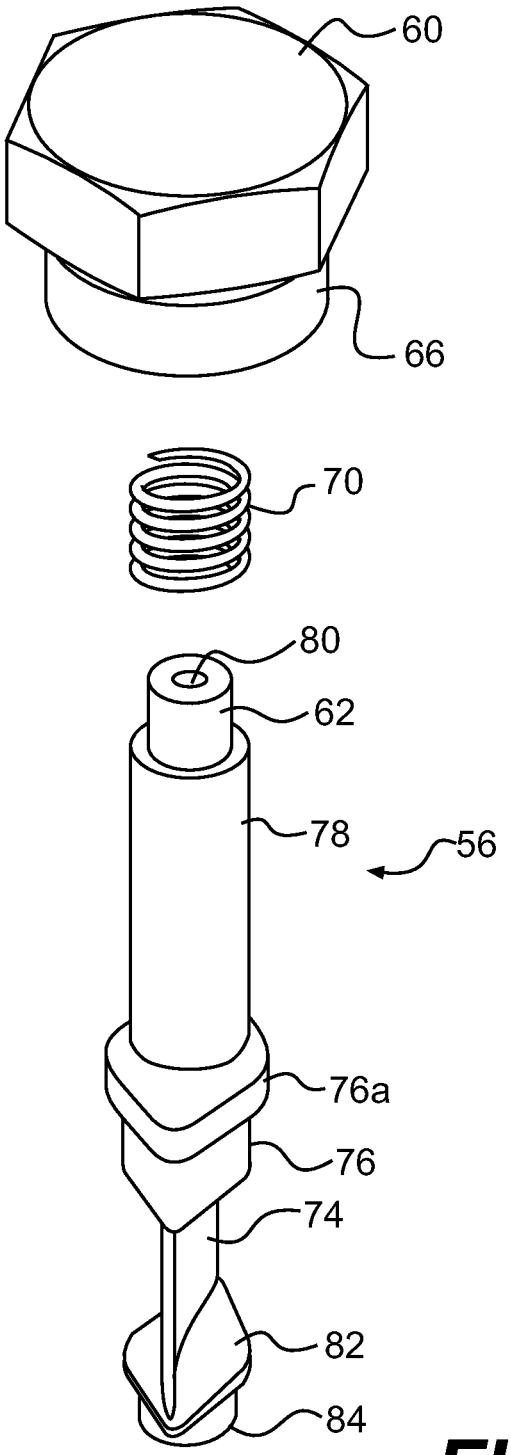
FIG. 6 is a schematic perspective exploded view including an exemplary embodiment of a stator vane shown from a different angle.

According to some embodiments, stator vane 56 may include an airfoil 74 configured to direct air within, for example, a portion of compressor section 12, as shown in FIG. 5. For example, airfoil 74 may have a curved cross-section (see FIG. 6), which, in combination with a complimentary airfoil of rotor vanes 18, serves to compress air drawn through compressor section 12. Exemplary stator vane 56 may also include a locator boss 76 associated with one end of airfoil 74. Locator boss 76 may have a cross-section that corresponds to the shape of enlarged aperture 43*b* in outer ring 40 of stator ring assembly 36. According to some embodiments, the cross-sectional shape of locator boss 76 may be configured to prevent stator vane 56 from being assembled in stator ring assembly 36 in a manner resulting in airfoil 74 being curved in the incorrect direction with respect to other stator vanes 18 in stator ring assembly 36. For example, locator boss 76 may have an asymmetric cross-section.

Locator boss 76 may include a shoulder 76*a* configured to abut a surface of outer ring 40 of stator ring assembly 36 (see, e.g., FIG. 3). According to such embodiments, stator vane 56 may be retained between cap 60 and the surface of outer ring 40, with recess 64 of cap 60 providing longitudinal movement of stator vane 56. Biasing member 70 may be provided to bias shoulder 76*a* of locator boss 76 against the surface of outer ring 40.

Figure 7:
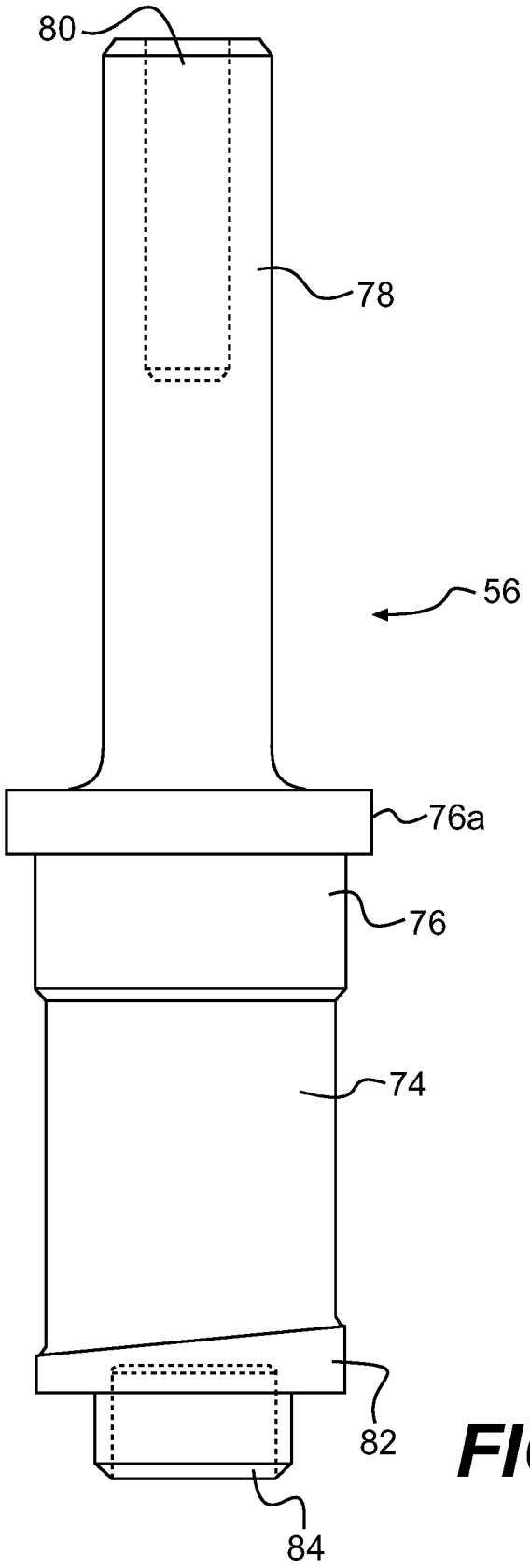
FIG. 7 is a schematic side view of an exemplary embodiment of a stator vane.

Stator vane 56 may also include a stem 78 coupled to locator boss 76 opposite airfoil 74. For example, stem 78 may extend between locator boss 76 and extension 62. Extension 62 and/or exemplary stem 78 may facilitate removal of stator vane 56 from outer case 11. For example, extension 62 and/or stem 78 may include a bore 80 (see FIG. 7) extending longitudinally toward locator boss 76. Bore 80 may be configured to be engaged by a tool (not shown), such that the tool can extend into port 58 in outer case 11, engage extension 62 and/or stem 78, so that stator vane 56 can be withdrawn from outer case 11 via port 58. For example, bore 80 may be internally threaded, and the tool may include a portion having external threads configured to engage the internal threads of exemplary bore 80.

At the end of airfoil 74 opposite locator boss 76, a lug 82 may be provided for receipt in enlarged aperture 43*a* of inner ring 38 of stator ring assembly 36. For example, lug 82 may have a cross-section corresponding to the shape of enlarged aperture 43*a*. According to some embodiments, the cross-sectional shape of lug 82 may be configured to prevent stator vane 56 from being assembled in stator ring assembly 36 in a manner resulting in airfoil 74 being curved in the incorrect direction with respect to other stator vanes 18 in ring assembly 36. For example, lug 82 may have an asymmetric cross-section.

According to some embodiments, stator vane 56 may include a projection 84 extending from lug 82 opposite airfoil 74. Exemplary projection 84 may discourage leakage of air through enlarged aperture 43*a* of inner ring 38 of stator ring assembly 36. Some embodiments of stator vane 56 do not include a projection 84.

Exemplary stator vane 56 may be formed from any suitable material. For example, stator vane 56 may be formed from any material that is temperature resistant across a wide range of temperatures, such as a nickel-chromium alloy such as, for example, an alloy marketed under the trade name INCONEL 718. According to some embodiments, stator vane 56 may be formed via machining.

Exemplary stator vane 56 may facilitate balancing of rotating assembly 33 of GTE 10. For example, exemplary balancing ring 50 may be associated with compressor rotor 20 or turbine rotor 28, and balancing ring 50 may be configured to permit addition, removal, and/or repositioning of weights with respect to balancing ring 50 to improve the rotating balance of rotating assembly 33. For example, rotating assembly 33 may be rotated at, for example, a rotating speed representative of operational speeds of GTE 10, such as, for example, 10,000 rpm. The degree of balance of rotating assembly 33 may be evaluated according to methods known to those skilled in the art. Following such evaluation, weight may be added, removed, and/or repositioned with respect to balancing ring 50 in order to improve the rotating balance of rotating assembly 33.

To facilitate addition, removal, and/or repositioning of weight with respect to balancing ring 50, exemplary stator vane 56 may be removed from GTE 10 via port 58. For example, cap 60 may be removed from port 58 of outer case 11 to gain access to stator vane 56. Some embodiments of stator vane 56 may include a stem 78 having an internally threaded bore 80, and stator vane 56 may be removed via port 58 using a tool having an externally threaded portion configured to engage the threads of bore 80, so that stator vane 56 may be withdrawn from port 58 of outer case 11 with assistance of the tool. After removal of stator vane 56, access to balancing ring 50 may be gained via enlarged apertures 43*a* and 43*b* in stator ring assembly 36, thereby permitting addition, removal, and/or repositioning of weights with respect to balancing ring 50.

Following addition, removal, and/or repositioning of weight with respect to balancing ring 50, stator vane 56 may be inserted into port 58 and reassembled to stator ring assembly 36, such that locator boss 76 and lug 82 are positioned in enlarged apertures 43*a* and 43*b* of inner and outer rings 38 and 40, respectively, of stator ring assembly 36. Biasing member 70 may be positioned around extension 62 of stator vane 56, ring 72 may be positioned around port 58, and cap 60 may be mounted on port 58 of outer case 11, such that extension 62 extends into recess 64 of cap 60.

After stator vane 56 has been reassembled in GTE 10, rotating assembly 33 may be rotated again, and the degree of balance of rotating assembly 33 may be evaluated again according to methods known to those skilled in the art to determine whether rotating assembly 33 is balanced to a desired degree.

INDUSTRIAL APPLICABILITY

Exemplary GTE 10 may be used, for example, to supply power to machines, such as airplanes, locomotives, boats, ships, trucks, automobiles, electric generators, pumps, and/or other machines configured to perform work. For example, operation of GTE 10 may result in rotational power at turbine hub 30, which may be operably coupled to a load L for performing work (see FIG. 1). For example, turbine rotor 28 may be coupled to drive shaft 34 and/or a reduction transmission (not shown), which, in turn, may be coupled to load L, which may be used, for example, to supply power to machines.

Exemplary stator vane 56 for GTE 10 may facilitate balancing of rotating assembly 33 of GTE 10, which may reduce vibration during operation of GTE 10. For example, exemplary stator vane 56 may be removed from GTE 10 to provide access to balancing ring 50, even if balancing ring 50 is not positioned in GTE 10 to be accessible via the intake opening of the compressor air flow path. In addition, stator vane 56 may render it possible to provide access to a balancing ring 50 located in a longitudinal portion of GTE 10 associated with stator vanes (i.e., in compressor section 12 or turbine section 16). Thus, it may be possible to reduce the length of GTE 10 relative to GTEs having a section solely for accommodating a balancing ring. As a result, it may be possible to reduce the footprint of GTE 10.

It will be apparent to those skilled in the art that various modifications and variations can be made to the exemplary disclosed methods and GTE. Other embodiments will be apparent to those skilled in the art from consideration of the specification and practice of the exemplary disclosed methods and GTE. It is intended that the specification and examples be considered as exemplary only, with a true scope being indicated by the following claims and their equivalents.

What is claimed is:

1. A method for balancing a rotating assembly of a gas turbine engine, the method comprising:

removing a stator vane from a compressor section of the gas turbine engine that is closest to a combustor section, wherein removing the stator vane provides access to a rotating assembly of the gas turbine engine;

at least one of adding, removing, and repositioning a weight with respect to the rotating assembly via access to the rotating assembly provided by removing the stator vane; and reinserting the stator vane back into the compressor section of the gas turbine engine, wherein reinserting the stator vane includes:

positioning a biasing member around an extension of the stator vane; and mounting a cap on an outer case of the gas turbine engine, such that the extension extends into a recess of the cap, wherein removing the stator vane includes engaging internal threads of a bore extending longitudinally within at least one of the extension and a stem of the stator vane.

2. The method of claim 1, wherein removing the stator vane includes removing the stator vane from a ring assembly including a plurality of stator vanes.

3. The method of claim 1, wherein removing the stator vane includes withdrawing the stator vane via an opening in the outer case of the gas turbine engine.

4. The method of claim 1, wherein the at least one of adding, removing, and repositioning a weight with respect to the rotating assembly includes at least one of adding, removing, and repositioning a weight relative to a balancing ring coupled to the rotating assembly.

5. The method of claim 4, wherein the at least one of adding, removing, and repositioning a weight relative to the rotating assembly includes at least one of adding, removing, and repositioning a threaded member configured to engage threads of the balancing ring.

6. The method of claim 1, further including rotating the rotating assembly and evaluating a degree of balance of the rotating assembly.

7. The method of claim 6, further including at least one of adding, removing, and repositioning a weight relative to the rotating assembly based on the degree of balance of the rotating assembly.

8. The method of claim 1, wherein removing the stator vane includes disengaging the cap from the outer case of the gas turbine engine and exposing an end of the stator vane to facilitate removing the stator vane from the outer case.

9. The method of claim 8, further including withdrawing the stator vane from the outer case.

10. A stator vane for a gas turbine engine, the stator vane comprising:

an airfoil configured to direct air;

a locator boss coupled to the airfoil and configured to orient the airfoil relative to air flow through the gas turbine engine;

a stem coupled to the locator boss and extending opposite the airfoil, wherein the stem is configured to facilitate removal of the stator vane from a compressor stage of the gas turbine engine closest to a combustor section;

an extension associated with the stem, wherein the extension is configured to cooperate with a cap configured to engage an outer case of the gas turbine engine and couple the stator vane to the gas turbine engine; and a bore extending longitudinally within at least one of the stem and the extension and having internal threads configured to facilitate removal of the stator vane, wherein a biasing member is associated with the extension and configured to permit longitudinal movement of the stator vane relative to the cap.

11. The stator vane of claim 10, wherein the locator boss includes an asymmetric cross-section.

12. The stator vane of claim 10, wherein the stem includes a threaded surface configured to facilitate removal of the stator vane from the gas turbine engine.

13. The stator vane of claim 10, further including a lug opposite the airfoil from the locator boss, wherein the lug is configured to orient the airfoil relative to air flow through the gas turbine engine.

14. A gas turbine engine comprising:

an outer case;

a compressor section at least partially contained in the outer case, the compressor section including a plurality of compressor stator vanes and a compressor rotor having a plurality of compressor rotor vanes;

a combustor section at least partially contained in the outer case, the combustor section being configured to combust compressed air received from the compressor section; and a turbine section at least partially contained in the outer case, the turbine section including a plurality of turbine stator vanes and a turbine rotor having a plurality of turbine rotor vanes, wherein at least one of the stator vanes is configured to be removed from a compressor stage of the gas turbine engine closest to the combustor section via a port in the outer case, and wherein the at least one of the stator vanes includes a stem and an extension configured to cooperate with a cap engaging the outer case and coupling the at least one stator vane to the gas turbine engine, wherein a biasing member is associated with the extension and configured to permit longitudinal movement of the at least one stator vane relative to the cap, and wherein the at least one of the stator vanes includes a bore extending longitudinally within at least one of the stem and the extension and having internal threads configured to facilitate removal of the stator vane.

15. The gas turbine engine of claim 14, wherein the compressor section includes at least one ring assembly including a plurality of stator vanes, and wherein the at least one ring assembly includes the at least one stator vane configured to be removed from the gas turbine engine via the port in the outer case.

16. The gas turbine engine of claim 15, wherein the at least one stator vane configured to be removed from the gas turbine engine via the port in the outer case is configured to be removed from the gas turbine engine without removing the at least one ring assembly from the outer case.

17. The gas turbine engine of claim 15, wherein the compressor section includes a plurality of compressor stages, and wherein the at least one ring assembly is a portion of a compressor stage located closest to the combustion section.

18. The gas turbine engine of claim 17, further including a balancing ring associated with the compressor rotor, and wherein the at least one ring assembly is located adjacent the balancing ring.

* * * * *